US005382352A

United States Patent [19]

Hansen et al.

[11] Patent Number: 5,382,352

[45] Date of Patent: Jan. 17, 1995

[54] CONVERSION OF $NO_x$ IN FCC BUBBLING BED REGENERATOR

[75] Inventors: Allen R. Hansen, Glassboro, N.J.; David L. Johnson, Glen Mills, Pa.; Scott A. Stevenson, Newtown, Pa.; Paul H. Schipper, Doylestown, Pa.; Mohsen N. Harandi, Langhorne, Pa.

[73] Assignee: Mobil Oil Corporation, Fairfax, Va.

[21] Appl. No.: 963,357

[22] Filed: Oct. 20, 1992

[51] Int. Cl.[6] ..... C10G 11/00; C01B 21/00

[52] U.S. Cl. ..... 208/121; 208/113; 208/118; 423/239.1; 423/239.2; 502/42

[58] Field of Search ..... 208/113, 118, 121; 423/239, 239.1, 239.2; 502/42

[56] References Cited

U.S. PATENT DOCUMENTS

| | | | |
|---|---|---|---|
| 3,923,686 | 12/1975 | Stine et al. | 252/417 |
| 4,235,704 | 11/1980 | Luckenbach | 208/113 |
| 4,812,430 | 3/1989 | Child | 208/113 |
| 4,828,680 | 5/1989 | Green et al. | 208/120 |
| 4,851,374 | 7/1989 | Yan et al. | 208/113 |
| 4,991,521 | 2/1991 | Green et al. | 110/347 |
| 5,006,495 | 4/1991 | Pappal et al. | 502/42 |
| 5,015,362 | 5/1991 | Chin | 208/113 |
| 5,106,799 | 4/1992 | Green et al. | 502/42 |

*Primary Examiner*—Helen M. S. Sneed
*Assistant Examiner*—Walter D. Griffin
*Attorney, Agent, or Firm*—Alexander J. McKillop; Malcolm D. Keen; Richard D. Stone

[57] ABSTRACT

Oxides of nitrogen ($NO_x$) emissions from FCC regenerators in complete CO combustion mode are reduced by degrading regenerator performance to increase the coke on regenerated catalyst. High zeolite content cracking catalyst, regenerated to contain more coke, gives efficient conversion of feed and reduces $NO_x$ emissions from the regenerator. Operating with less catalyst, e.g., 30–60% of the normal amount of catalyst in the bubbling dense bed, can eliminate most $NO_x$ emissions while increasing slightly plant capacity and reducing catalyst deactivation.

20 Claims, No Drawings

CONVERSION OF $NO_x$ IN FCC BUBBLING BED REGENERATOR

BACKGROUND OF THE INVENTION

1. Field of the Invention

The invention relates to catalytic reduction of oxides of nitrogen, $NO_x$, produced in the bubbling dense bed regenerators associated with catalytic cracking unit regenerators operating in complete CO combustion mode.

2. Description of the Related Art $NO_x$, or oxides of nitrogen, in flue gas streams from FCC regenerators operating in complete CO burn mode is a pervasive problem. FCC units process heavy feeds containing nitrogen compounds, and much of this material is eventually converted into $NO_x$ emissions. There may be some nitrogen fixation, or conversion of nitrogen in regenerator air to $NO_x$, but most of the $NO_x$ in the regenerator flue gas is believed to come from oxidation of nitrogen compounds in the feed.

Although all FCC regenerators produce some $NO_x$, the problem is more severe in bubbling bed regenerators, as opposed to high efficiency regenerators. High efficiency regenerators burn most of the coke in a fast fluidized bed coke combustor. Such regenerators have few stagnant regions. Bubbling bed regenerators may have stagnant regions and will have large bubbles of air passing through the bed, leading to localized areas of high oxygen concentration. Although the reasons for the different $NO_x$ emissions in these two type of regenerator are perhaps not completely understood, all agree that $NO_x$ emissions are usually significantly higher, frequently twice as high, from bubbling bed regenerators.

Several powerful ways have been developed to deal with the problem. The approaches fall into roughly five categories:

1. Feed hydrotreating, to keep $NO_x$ precursors from the FCC unit.
2. Segregated cracking of fresh feed.
3. Process approaches which reduce the amount of $NO_x$ formed in a regenerator via regenerator modifications. 4. Catalytic approaches, using a catalyst or additive which is compatible with the FCC reactor, which suppress $NO_x$ formation or catalyze its reduction. 5. Stack gas cleanup methods downstream of the FCC unit.

The FCC process will be briefly reviewed, followed by a review of the state of the art in reducing $NO_x$ emissions.

FCC Process

Catalytic cracking of hydrocarbons is carried out in the absence of externally supplied $H_2$ unlike hydrocracking in which H2 is added during the cracking step. An inventory of FCC catalyst cycles between a cracking reactor and a catalyst regenerator. Hydrocarbon feed contacts FCC catalyst in a reactor at 425° C.–600° C., usually 460° C.–560° C. The hydrocarbons crack, and deposit carbonaceous hydrocarbons or coke on the catalyst. The cracked products are separated from the coked catalyst, which is then stripped of volatiles, usually with steam, and is regenerated. In the catalyst regenerator, the coke is burned from the catalyst with oxygen-containing gas, usually air. Coke burns off, restoring catalyst activity and simultaneously heating the catalyst to, e.g., 500° C.–900° C., usually 600° C.–750° C. Flue gas formed by burning coke in the regenerator may be treated for removal of particulates and for conversion of carbon monoxide, after which the flue gas is normally discharged into the atmosphere.

Most FCC units use zeolite-containing catalyst having high activity and selectivity. These catalysts are generally believed to work best when the amount of coke on the catalyst after regeneration is relatively low.

Many FCC units operate in complete CO combustion mode, i.e., the mole ratio of $CO_2/CO$ is at least 10. Refiners try to burn CO completely within the catalyst regenerator to conserve heat and to minimize air pollution. Among the ways suggested to decrease the amount of carbon on regenerated catalyst and to burn CO in the regenerator is to add a CO combustion promoter metal to the catalyst or to the regenerator.

Such metals have been added as an integral component of the cracking catalyst and as a separate additive. U.S. Pat No. 2,647,860 proposed adding 0.1 to 1 weight percent chromic oxide to a cracking catalyst to promote combustion of CO. U.S. Pat. No. 3,808,121, taught using relatively large-sized particles containing CO combustion-promoting metal in a regenerator. The FCC catalyst circulated, but the combustion-promoting particles remained in the regenerator.

U.S. Pat. Nos. 4,072,600 and 4,093,535 teach use of combustion-promoting metals such as Pt, Pd, Ir, Rh, Os, Ru and Re in cracking catalysts in concentrations of 0.01 to 50 ppm, based on total catalyst inventory. This approach is so successful that most FCC units now use Pt CO combustion promoter. This reduces CO emissions, but usually increases nitrogen oxides ($NO_x$) in the regenerator flue gas.

The use of Pt CO combustion promoter, the trend to operate in complete CO combustion mode, worse feeds containing more nitrogen, and more stringent local regulations, have all combined to make $NO_x$ emissions a serious problem. The refining industry has resorted to different types or amounts of CO combustion promoter, and also to remedies ranging from feed hydrotreating to stack gas scrubbing to reduce $NO_x$. Some improved CO combustion promoters which make less $NO_x$ will be reviewed first, followed by a review of the other $NO_x$ control approaches.

Catalytic Approaches to $NO_x$ Control

The work that follows is generally directed at special catalysts which promote CO afterburning, but which do not promote formation of as much $NO_x$.

U.S. Pat. No. 4,300,997 and U.S. Pat. No. 4,350,615, are both directed to use of Pd-Ru CO-combustion promoter. The bi-metallic CO combustion promoter is reported to do an adequate job of converting CO to $CO_2$, while minimizing the formation of $NO_x$.

U.S. Pat. No. 4,199,435 suggests steam treating conventional metallic CO combustion promoter to decrease $NO_x$ formation without impairing too much the CO combustion activity of the promoter.

U.S. Pat. No. 4,235,704 suggests too much CO combustion promoter causes $NO_x$ formation, and calls for monitoring the $NO_x$ content of the flue gases, and adjusting the concentration of CO combustion promoter in the regenerator based on the amount of $NO_x$ in the flue gas. As an alternative to adding less CO combustion promoter the patentee suggests deactivating it in place, by adding something to deactivate the Pt, such as lead, antimony, arsenic, tin or bismuth.

U.S. Pat. No. 5,002,654, Chin, which is incorporated by reference, taught the effectiveness of a zinc based additive in reducing $NO_x$. Relatively small amounts of zinc oxides impregnated on a separate support having little or no cracking activity produced an additive which could circulate with the FCC equilibrium catalyst and reduce $NO_x$ emissions from FCC regenerators.

U.S. Pat. No. 4,988,432 Chin, incorporated by reference, taught the effectiveness of an antimony based additive at reducing $NO_x$.

Many refiners are reluctant to add additional metals to their FCC units out of environmental concerns. One concern is that some additives, such as zinc, may vaporize under some conditions experienced in FCC units. Many refiners are concerned about adding antimony to their FCC catalyst inventory.

All additives will also add to the cost of the FCC process and dilute the FCC equilibrium catalyst to some extent.

Feed Hydrotreating

Some refiners now go to the expense of hydrotreating feed. This is usually done more to meet sulfur specifications in various cracked products, an SOx limitation in regenerator flue gas, or improve feed crackability rather than meet a $NO_x$ limitation. Hydrotreating reduces to some extent the nitrogen compounds in FCC feed, and reduces the $NO_x$ emissions from the regenerator, but it is not a very efficient way to reduce $NO_x$. The capital and operating expenses of hydrotreating FCC feed are so great that its use can not normally be justified merely to reduce $NO_x$ emissions.

Segregated Feed Cracking

U.S. Pat. No. 4,985,133, Sapre et al, which is incorporated by reference, taught that refiners processing multiple feeds could reduce $NO_x$ emissions, and improve performance in the cracking reactor, by keeping high and low nitrogen feeds segregated, and adding them to different elevations in the FCC riser.

This is an unusual and profitable way to reduce $NO_x$ emissions, but refiners may not have segregated feeds available, i.e., the refiner relies on a single crude source.

Process Approaches to $NO_x$ Control

Process modifications are suggested in U.S. Pat. No. 4,413,573 and U.S. Pat. No. 4,325,833 directed to two- and three-stage FCC regenerators, which reduce $NO_x$ emissions.

U.S. Pat. No. 4,313,848 teaches countercurrent regeneration of spent FCC catalyst, without backmixing, to minimize $NO_x$ emissions.

U.S. Pat. No. 4,309,309 teaches adding a vaporizable fuel to the upper portion of a FCC regenerator to minimize $NO_x$ emissions. Oxides of nitrogen formed in the lower portion of the regenerator are reduced in the reducing atmosphere generated by burning fuel in the upper portion of the regenerator.

U.S. Pat. No. 4,542,114 minimized the volume of flue gas by using oxygen rather than air in the FCC regenerator, with consequent reduction in the amount of flue gas produced.

Denox with Carbon/Coke/Coal

In Green et al, U.S. Pat. No. 4,828,680, which is incorporated by reference, $NO_x$ emissions from a FCC unit were reduced by adding sponge coke or coal to the circulating inventory of cracking catalyst. The carbonaceous particles selectively absorbed metal contaminants in the feed and reduced $NO_x$ emissions in certain instances. Many refiners are reluctant to add coal or coke to their FCC units, such carbonaceous materials will burn and increase the heat release in the regenerator. Most refiners would prefer to reduce, rather than increase, neat release in their regenerators.

U.S. Pat. No. 4,991,521, Green and Yan, showed that a regenerator could be designed so that coke on spent FCC catalyst could be used to reduce $NO_x$ emissions from an FCC regenerator. The patent taught a two stage FCC regenerator. Flue gas from a second regenerator stage contacted coked catalyst in a first stage. Although effective at reducing $NO_x$ emissions, this approach is not readily adaptable to existing units, and there is some concern that this may produce some CO.

Another use of coke on spent catalyst to reduce $NO_x$ was reported in U.S. Pat. No. 5,006,945, which is incorporated by reference. The incoming spent catalyst, or at least a portion of it, was added to the dilute phase region of a bubbling bed regenerator, so that the coke on catalyst could reduce $NO_x$ species in the dilute phase flue gas. This approach is good, but may increase dilute phase catalyst loading, and will require considerable unit modification.

Metals Passivation with Coke

Although not directly applicable to $NO_x$ reduction, some additional work with coke on regenerated catalyst, merits a brief review. This work is not directly applicable because it was directed at regenerators in partial CO combustion mode.

Many FCC units processing heavy feeds, those containing large amounts of residual material, have severe problems with metals and with heat balance. Some operators ameliorate to some extent the heat balance problem by operating the FCC regenerator in a partial CO burn (to shift much of the heat of combustion to a downstream CO boiler).

Some operators may operate in partial CO burn mode and limit regeneration of the catalyst to keep more coke on regenerated catalyst. Operating with modest amounts of coke may prevent the formation of highly oxidized vanadia species.

Although such an operation may help passivate metals to some extent, it will not help reduce $NO_x$ emissions. The FCC regenerator, operating in partial CO burn mode, produces little $NO_x$, but an abundance of $NO_x$ precursors, which burn in the CO boiler to form $NO_x$.

Thus while partial CO combustion mode can practically eliminate $NO_x$ emissions from FCC regenerator flue gas it merely shifts the problem to the downstream CO boiler, because the nitrogen compounds in the feed are released in a form which burns in the CO boiler to form about as much or more $NO_x$ as if the regenerator operated in complete CO burn mode.

Although not related directly to the problems of $NO_x$ from bubbling dense bed catalyst regenerators, brief mention should be made of a high efficiency regenerator operating with large amounts of coke. U.S. Pat. No. 3,923,686, which is incorporated by reference, appears to teach a fast fluidized bed coke combustor operating under a dilute phase transport riser, with catalyst regeneration limited to increase the coke on regenerated catalyst. The coke combustor operated with recycle of hot regenerated catalyst to it, which may be why the patent calls for addition of fuel gas to the dilute phase transport riser to increase temperatures sufficiently to promote afterburning.

High efficiency regenerators (coke combustor-dilute phase transport riser, operating with catalyst recycle to the coke combustor) make less $NO_x$ than bubbling bed regenerators. The design shown in '686 is unusual in that there is no catalyst recycle to the coke combustor, but there is addition of more fuel to the transport riser.

High efficiency regenerators are difficult to run without some catalyst recycle, and the trend in modern FCC units is to take heat out of the regenerator, not add more fuel to it. The $NO_x$ emissions associated with the '686 regenerator are not reported. The only regenerator process comparison in the patent contrasted a prior art regenerator operation producing regenerated catalyst with 0.2 wt % coke with the process of the invention which contained 0.02 wt % coke. Thus controlled coke level was an order of magnitude less than the prior art coke level.

Denox with Reducing Atmospheres

Another process approach to reducing $NO_x$ emissions from FCC regenerators is to create a relatively reducing atmosphere in some portion of the regenerator by segregating the CO combustion promoter. Reduction of $NO_x$ emissions in FCC regenerators was achieved in U.S. Pat. Nos. 4,812,430 and 4,812,421 by using a conventional CO combustion promoter (Pt) on an unconventional support which permitted the support to segregate in the regenerator. Use of large, hollow, floating spheres gave a sharp segregation of CO combustion promoter in the regenerator. Disposing the CO combustion promoter on fines, and allowing these fines to segregate near the top of a dense bed, or to be selectively recycled into the dilute phase above a dense bed, was another way to segregate the CO combustion promoter.

Considerably effort has been spent on downstream treatment of FCC flue gas. This area will be briefly reviewed.

Stack Gas Treatment

It is known to react $NO_x$ in flue gas with $NH_3$. $NH_3$ is a selective reducing agent, which does not react rapidly with the excess oxygen which may be present in the flue gas. Two types of $NH_3$ process have evolved, thermal and catalytic.

Thermal processes, such as the Exxon Thermal $DeNO_x$ process, generally operate as homogeneous gas-phase processes at very high temperatures, typically around 1550°–1900° F. More details of such a process are disclosed by Lyon, R.K., Int. J. Chem. Kinet., 3, 315, 1976, which is incorporated herein by reference.

Older catalytic systems generally operate at temperatures of 300°–850° F., too low for direct use downstream of an FCC regenerator. Some of the new zeolitic catalyst systems operate at temperatures up to about 1000° F. This temperature is typical of flue gas streams. Unfortunately, the catalysts used in these processes are readily fouled, or the process lines plugged, by catalyst fines which are an integral part of FCC regenerator flue gas.

U.S. Pat. No. 4,521,389 and U.S. Pat. No. 4,434,147 disclose adding $NH_3$ to $NO_x$-containing flue gas to catalytically reduce the $NO_x$ to nitrogen.

U.S. Pat. No. 5,015,362, Chin, which is incorporated by reference, taught reducing $NO_x$ emissions by contacting flue gas with sponge coke or coal, and a catalyst effective for promoting reduction of $NO_x$ in the presence of such carbonaceous substances.

None of the approaches described above provides the perfect solution.

Feed pretreatment is expensive, and can usually only be justified for sulfur removal. Segregated cracking of feed is a significant benefit, but requires that a refiner have separate high and low nitrogen feeds available.

Process approaches, such as multi-stage or countercurrent regenerators, can reduce $NO_x$ emissions but require extensive rebuilding of the FCC regenerator. Because of site constraints (i.e., the space around the FCC is filled with other processing units) and because of capital constraints (i.e., many refiners can not afford to build a new regenerator), most refiners can not solve a $NO_x$ problem by rebuilding their units.

Various catalytic approaches, e.g., addition of lead or antimony, as taught in U.S. Pat. No. 4,235,704, to degrade the efficiency of the Pt function may help some but may fail to meet the ever more stringent $NO_x$ emissions limits set by local governing bodies and exacerbate catalyst disposal problems.

Stack gas cleanup methods are powerful, but the capital and operating costs are high.

We wondered if there was a way to take existing bubbling bed FCC regenerators, those operating in a complete CO combustion mode, and keep them in complete CO combustion, while reducing the $NO_x$ emissions associated with such regenerators.

We studied the work that others had done, and realized that one of the most powerful tools for reducing $NO_x$, the coke on spent catalyst, was always available, and yet almost totally eliminated in conventional regenerators.

We realized that existing FCC regenerators could be operated to "degrade" what had been considered their primary mission (production of clean burned catalyst) without significantly degrading operation of the overall cracking process, and while markedly reducing the $NO_x$ emissions coming from the regenerator.

BRIEF SUMMARY OF THE INVENTION

Accordingly the present invention provides in a process for the catalytic cracking of a nitrogen containing hydrocarbon feed to lighter products comprising: (a) cracking said feed by contacting said feed with a supply of hot, regenerated cracking catalyst in a fluidized catalytic cracking (FCC) reactor means operating at catalytic cracking conditions to produce a mixture of cracked products and spent cracking catalyst containing coke and nitrogen compounds; (b) separating said cracked products and spent cracking catalyst containing coke and nitrogen compounds to produce a cracked product vapor phase which is charged to a fractionation means and a spent catalyst phase which is charged to a stripping means; (c) stripping said spent catalyst in said stripping means to produce stripped catalyst containing coke and nitrogen compounds; and (d) regenerating said spent cracking catalyst in a catalyst regeneration means by contact with an oxygen-containing gas at complete CO combustion catalyst regeneration conditions sufficient to produce a flue gas having a $CO_2/CO$ mole ratio of at least 10:1 and to oxidize nitrogen compounds in said nitrogen containing coke to $NO_x$ and wherein said catalyst regeneration conditions include a catalyst inventory, a superficial vapor velocity, and a catalyst residence time sufficient to produce a regenerated catalyst containing at least 0.2 wt % coke and sufficient coke on catalyst in said regenerator to react with $NO_x$ formed therein and reduce at least a majority of the $NO_x$ formed in said regenerator to nitrogen within said regenerator by reaction with coke on catalyst; and removing regenerated catalyst, containing at least 0.2 wt % coke on catalyst, and charging same to said cracking reactor.

In another embodiment, the present invention provides a process for the catalytic cracking of a nitrogen containing hydrocarbon feed to lighter products comprising: cracking said feed by contacting said feed with a supply of hot, regenerated cracking catalyst containing at least 25 wt % large pore zeolite content in a fluidized catalytic cracking (FCC) reactor means operating at catalytic cracking conditions to produce a mixture of cracked products and spent cracking catalyst containing coke and nitrogen compounds; separating said cracked products and spent cracking catalyst containing coke and nitrogen compounds to produce a cracked product vapor phase which is charged to a fractionation means and a spent catalyst phase which is charged to a stripping means; stripping said spent catalyst in said stripping means to produce stripped catalyst containing coke and nitrogen compounds; regenerating said spent cracking catalyst in a catalyst regeneration means containing a single dense phase, bubbling fluidized bed by contact with an oxygen-containing gas to produce regenerated catalyst and $NO_x$ and wherein said catalyst regeneration conditions include a catalyst inventory, a superficial vapor velocity, and a catalyst residence time, wherein said regeneration conditions produce: a flue gas having a $CO_2/CO$ mole ratio of at least 10:1 and an oxygen content of less than 1.0 mole %; regenerated catalyst containing at least 0.1 wt % coke and sufficient coke on catalyst in said regenerator to react with $NO_x$ formed therein and reduce at least a majority of the $NO_x$ formed in said regenerator to nitrogen within said regenerator by reaction with coke on catalyst as compared to operation in the same regenerator operated at conditions to produce only half as much coke on regenerated catalyst with twice as much oxygen in flue gas; removing said regenerated catalyst and charging same to said cracking reactor.

The last embodiment provides for a method for reducing $NO_x$ emissions associated with the operation of an FCC catalyst regenerator associated with an FCC reactor cracking a nitrogen containing hydrocarbon feed to lighter products comprising: cracking a nitrogen containing feed by contacting said feed with a supply of hot, regenerated cracking catalyst comprising at least 25 wt % large pore zeolite, based on the zeolite content of fresh catalyst addition, in a fluidized catalytic cracking (FCC) reactor means operating at catalytic cracking conditions to produce a mixture of cracked products and spent cracking catalyst containing coke and nitrogen compounds; separating said cracked products and spent cracking catalyst containing coke and nitrogen compounds to produce a cracked product vapor phase which is charged to a fractionation means. and a spent catalyst phase which is charged to a stripping means; stripping said spent catalyst in said stripping means to produce stripped catalyst containing coke and nitrogen compounds; charging said stripped catalyst to a catalyst regenerator means comprising a single vessel for maintaining an inventory of catalyst as a bubbling, dense phase, fluidized bed; regenerating said stripped catalyst in said bubbling dense bed at complete CO combustion mode catalyst regeneration conditions including a catalyst residence time, temperature and air rates sufficient to burn coke and nitrogen compounds and wherein at least 90% of the carbon content of the coke is burned to $CO_2$ and less than 10% to CO, to produce a flue gas removed from said regenerator having a $CO_2/CO$ mole ratio of at least 10:1 and containing a given amount of $NO_x$, and a regenerated catalyst having a minor amount of coke; reducing the inventory and/or residence time of the spent catalyst in said bubbling dense bed regenerator by at least 25% and operating said regenerator at reduced inventory regeneration conditions sufficient to: reduce the $NO_x$ content of the regenerator flue gas by at least 50%; maintain a $CO_2/CO$ mole ratio in the flue gas of at least about 10; and increase the amount of coke on regenerated catalyst at least 33% as compared to full inventory catalyst regeneration; and removing regenerated catalyst from said reduced inventory regenerator and charging same to said cracking reactor.

DETAILED DESCRIPTION

The regeneration process of the present invention is an integral part of the catalytic cracking process. The essential elements of this process will be briefly reviewed.

The present invention is an improvement for use in any catalytic cracking unit which uses a bubbling bed catalyst regenerator operating in full CO combustion mode. The invention will be most useful in conjunction with the conventional all riser cracking FCC units, such as disclosed in U.S. Pat. No. 4,421,636, which is incorporated herein by reference.

Although the present invention is applicable to both moving bed and fluidized bed catalytic cracking units, the discussion that follows is directed to FCC units which are considered the state of the art.

FCC Feed

Any conventional FCC feed can be used. The process of the present invention is useful for processing nitrogenous charge stocks, even those containing more than 500 ppm total nitrogen compounds, and is especially useful in processing stocks containing very high levels of nitrogen compounds, such as those with more than 1000 wt ppm total nitrogen compounds.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been cracked.

Preferred feeds are gas oils, vacuum gas oils, atmospheric resids, and vacuum resids. The invention is most useful with feeds having an initial boiling point above about 650° F.

FCC Catalyst

Commercially available FCC catalysts may be used. The catalyst must contain relatively large amounts of large pore zeolite for maximum effectiveness, but such catalysts are readily available.

Preferred catalysts for use herein will usually contain at least 10 wt % large pore zeolite in a porous refractory matrix such as silica-alumina, clay, or the like. The zeolite content is preferably much higher than this, and should usually be at least 20 wt % large pore zeolite, with optimum results achieved when unusually large amounts of large pore zeolite, in excess of 30 wt %, are present in the catalyst. For optimum results, the catalyst should contain from 30 to 60 wt % large pore zeolite.

All zeolite contents discussed herein refer to the zeolite content of the makeup catalyst, rather than the zeolite content of the equilibrium catalyst, or E-Cat. Much crystallinity is lost in the weeks and months that the catalyst spends in the harsh, steam filled environment of modern FCC regenerators, so the equilibrium catalyst will contain a much lower zeolite content by classical analytic methods. Most refiners usually refer to the zeolite content of their makeup catalyst, and the MAT (Modified Activity Test) or FAI (Fluidized Activity Index) of their equilibrium catalyst, and this specification follows this naming convention.

Conventional zeolites such as X and Y zeolites, or aluminum deficient forms of these zeolites such as dealuminized Y (DEAL Y), ultrastable Y (USY) and ultrahydrophobic Y (UHP Y) may be used as the large pore cracking catalyst. The zeolites may be stabilized with Rare Earths, e.g , 0.1 wt % to 10 wt % RE.

Relatively high silica zeolite containing catalysts are preferred for use in the present invention. They withstand the high temperatures usually associated with complete combustion of CO to $CO_2$ within the FCC regenerator. Catalysts containing 30–60% USY or rare earth USY (REUSY) are especially preferred.

The catalyst inventory may also contain one or more additives, either present as separate additive particles, or mixed in with each particle of the cracking catalyst. Additives can be added to enhance octane (medium pore size zeolites, sometimes referred to as shape selective zeolites, i.e., those having a Constraint Index of 1–12, and typified by ZSM-5, and other materials having a similar crystal structure).

The FCC catalyst composition, per se, forms no part of the present invention.

CO Combustion Promoter

Use of a CO combustion promoter in the regenerator or combustion zone is not essential for the practice of the present invention, however, some may be present. These materials are well-known.

U.S. Pat. No. 4,072,600 and U.S. Pat. No. 4,235,754, which are incorporated by reference, disclose operation of an FCC regenerator with minute quantities of a CO combustion promoter. From 0.01 to 100 ppm Pt metal or enough other metal to give the same CO oxidation, may be used with good results. Very good results are obtained with as little as 0.1 to 10 wt. ppm platinum present on the catalyst in the unit.

We believe our process will work very well with no, or very little CO combustion additive. Although we prefer to minimize the use of Pt, we recognize that most FCC units, and most E-Cat which is sold, contains some Pt. Most refiners will want a way to reduce $NO_x$ which is compatible with the way they run their units, and which tolerates use of purchased E-Cat for startup which purchased catalyst will usually will have some Pt present. Based on our experiments, discussed at greater length hereafter, our process works very well when conventional amounts of Pt CO combustion promoter are present.

SOx Additives

Additives may be used to adsorb SOx. These are believed to be primarily various forms of alumina, rare-earth oxides, and alkaline earth oxides, containing minor amounts of Pt, on the order of 0.1 to 2 ppm Pt.

Additives for removal of SOx are available from several catalyst suppliers, such as Davison's "R" or Katalistiks International, Inc.'s "DESOX".

The process of the present invention is believed to work fairly well with these additives, although our unusual operation of the regenerator, to degrade its effectiveness for coke combustion, may degrade to some extent the effectiveness of SOx capture additives.

Metals Passivation

The process of the present invention will supplement conventional metals passivation technology.

FCC Reactor Conditions

Conventional riser cracking conditions may be used. Typical riser cracking reaction conditions include catalyst/oil ratios of 0.5:1 to 15:1 and preferably 3:1 to 8:1, and a catalyst contact time of 0.1–50 seconds, and preferably 0.5 to 10 seconds, and most preferably about 0.75 to 5 seconds, and riser top temperatures of 900° to about 1050° F.

It is important to have good mixing of feed with catalyst in the base of the riser reactor, using conventional techniques such as adding large amounts of atomizing steam, use of multiple nozzles, use of atomizing nozzles and similar technology.

It is preferred, but not essential, to have a riser catalyst acceleration zone in the base of the riser.

It is preferred, but not essential, to have the riser reactor discharge into a closed cyclone system for rapid and efficient separation of cracked products from spent catalyst. A preferred closed cyclone system is disclosed in U.S. Pat. No. 4,502,947 to Haddad et al, which is incorporated by reference.

It is preferred but not essential, to rapidly strip the catalyst just as it exits the riser, and upstream of the conventional catalyst stripper. Stripper cyclones disclosed in U.S. Pat. No. 4,173,527, Schatz and Heffley, which is incorporated herein by reference, may be used.

It is preferred, but not essential, to use a hot catalyst stripper. Hot strippers heat spent catalyst by adding some hot, regenerated catalyst to spent catalyst. Suitable hot stripper designs are shown in U.S. Pat. No. 3,821,103, Owen et al, which is incorporated herein by reference. If hot stripping is used, a catalyst cooler may be used to cool the heated catalyst before it is sent to the catalyst regenerator. A preferred hot stripper and catalyst cooler is shown in U.S. Pat. No. 4,820,404, Owen, which is incorporated by reference.

The FCC reactor and stripper conditions, per se, can be conventional.

Catalyst Regeneration

The process and apparatus of the present invention can use conventional bubbling dense bed FCC regenerators which are designed to operate in full CO combustion mode. The regenerators must be operated in an unusual and "uncomfortable" way. The regenerators must be operated so as to maintain substantially complete CO combustion characteristics, so that at least 90% of the carbon in the flue gas is in the form of $CO_2$ and less than 10% is in the form of CO, while simultaneously producing "dirty" rather than clean burned catalyst.

Most FCC regenerators are bubbling bed regenerators, with a single bubbling dense phase fluidized bed of catalyst in the regenerator. All FCC regenerators built from the 40's through the late 70's were bubbling bed regenerators. Perhaps half of the ones built in the 80's and 90's are bubbling bed regenerators. These units operate with large amounts of catalyst, because the bubbling bed regenerators are not very efficient at burning coke, hence a large inventory and long residence time in the regenerator were needed to get clean burned catalyst.

Poor contacting of large bubbles of regeneration gas with spent catalyst, created ideal conditions for $NO_x$ formation. In many regenerator, poor circulation of catalyst within the regenerator (in some regenerators most of the bubbling dense was stagnant made the problem worse. Some portions of the regenerator (those where large amounts of spent catalyst poured in) were almost in partial CO burn mode. Some portions (in the stagnant regions of the bed) had severely oxidizing conditions. $NO_x$ precursors could form in coke rich regions, to be oxidized to $NO_x$ by the prevailing oxidizing atmosphere. Coke burned in a coke lean region would immediately form $NO_x$, with no carbon around to permit its reduction to nitrogen.

Even bubbling bed regenerators with almost perfect catalyst circulation, e.g., the Orthoflow regenerator available from the M. W. Kellogg Co, produce some $NO_x$, more $NO_x$ than a high efficiency regenerator would, but somewhat less than an older style bubbling bed regenerator with poor catalyst circulation.

In our process, we do not have to address the problems of poor catalyst circulation, nor poor contact of bubbles of regeneration gas with the dense bed. All regenerators would work better without stagnant regions, and all would work better without bubbles bypassing the bed. Our process makes these deficiencies far more tolerable, by requiring a relatively poor regeneration of catalyst, to produce much higher coke levels on regenerated catalyst. In bubbling bed regenerators with no stagnant regions, our process will further reduce $NO_x$ emissions.

The easiest way to maintain complete CO combustion, with only partial coke combustion, in a bubbling bed regenerator is to leave out much of the catalyst inventory. Alternatively, spacers, or refractory can be added to reduce the volume of catalyst in the dense bed. In many units the "bathtub" will be lowered or sunk deeper into the bubbling dense bed.

There are many benefits to operating with less catalyst.

1. The catalyst inventory in the regenerator can be reduced up to 50%.
2. Catalyst deactivation is significantly reduced.
3. Catalyst attrition will be reduced.
4. The effect of Ni and V on catalyst is sharply reduced.
5. Less work is required of the air blower, because less energy will be needed to blow air through the reduced height of catalyst in the regenerator, or through the reduced density if a staged down catalyst bed and higher superficial velocity are used having the same height as a prior, larger diameter bed.

Enough catalyst should be left to seal the "bathtub" or other catalyst withdrawal means. In the very few units which are limited in catalyst circulation rates by seal or head requirements in the FCC regenerator it may not necessary to reduce catalyst circulation. In most units this will not be limiting, and these can be modified at the next turnaround so that catalyst circulation can be maintained even with reduced inventory in the regenerator.

There will be a slight loss in conversion from the increase in coke level on catalyst. This loss will not be severe if the preferred high zeolite content FCC catalysts we prefer are used. Any conversion loss from coke will also be offset by reduced steaming of catalyst in the regenerator, and reduced catalyst losses.

Other ways to achieve higher coke on regenerated in catalyst, while retaining complete CO combustion, include operation at a lower temperature, oxygen depletion and operation with worse feeds. These will not necessarily work as well as less catalyst, and may not, e.g., reduce the air blower power requirement, but they should be considered on a unit by unit basis. Each will be briefly reviewed.

Lower temperatures reduce coke burning rates. Lower temperatures can be achieved by reduced air preheat, or by operating with catalyst coolers.

Oxygen depletion, or reducing the average oxygen content of the regeneration gas by recycling flue gas will reduce coke burning rates.

Feeds containing large amounts of coke precursors, such as resids, can be used to increase coke yield, and coke on regenerated catalyst. These feeds usually are also difficult to crack, frequently contain large amounts of basic nitrogen that will increase $NO_x$ emissions, and usually introduce more unwanted metals into the unit. These troublesome characteristics also reduce the value of such feeds, making it very profitable to upgrade them.

The carbon on regenerated catalyst will preferably be at least 0.1 wt % coke, and preferably at least 0,125 wt % coke. $NO_x$ emissions will be reduced even more if the catalyst contains more than 0.15 or 0.2 wt % coke. There is no upper limit on coke set by $NO_x$ emissions, the more coke there is on regenerated catalyst the less $NO_x$ will survive the regeneration process. There is some loss of catalyst activity with increasing coke on regenerated catalyst, but the loss is not severe with the preferred high zeolite content, high activity catalysts specified for use herein. In most units, operation with from 0.1 to 1 wt % coke on regenerated catalyst will give satisfactory results, with even better results achieved with 0.125 to 0.75 wt % coke on regenerated catalyst. Preferably, the coke level is from 0.14 to 0.5 wt % coke, more preferably from 0.15 to 0.35 wt % coke, and most preferably from 0.15 to 0.25 wt % coke. By coke we mean not only carbon, but minor amounts of hydrogen associated with the coke, and perhaps even very minor amounts of unstripped heavy hydrocarbons which remain on catalyst. Expressed as wt % carbon, the numbers are essentially the same, but 5 to 10% less.

The CO content of the flue gas should be sufficiently low to permit its discharge directly to the atmosphere, without use of a CO boiler or other CO combustion means. The CO content should be below 500 mole ppm, and preferably below 200 mole ppm, more preferably below 100 mole ppm and most preferably below 50 mole ppm.

The oxygen content of the flue gas should be relatively low, and preferably is less than the CO content. This is a marked departure from conventional approaches to catalyst regeneration, wherein low CO emissions are usually achieved by operating with large amounts of excess oxygen in the flue gas, more than 2% oxygen in the flue gas.

We prefer to operate with less oxygen than is conventional for regenerators in complete CO combustion mode, but our process tolerates operation with 1%, 2% or even perhaps up to 3mole % oxygen in regenerator flue gas.

Best results are achieved when the flue gas contains less than 2% oxygen, and preferably less than 1 mole % oxygen, most preferably less than 0.8 mole % oxygen down to 0.5 mole % oxygen, or even less. Our pilot plant data show that effective $NO_x$ reduction can be achieved even with 2% oxygen in the regenerator flue gas, but we think that commercially most refiners will prefer to run with less excess oxygen, both to reduce $NO_x$ even further, and to further increase the coke burning capacity of the unit.

The temperature in the bubbling bed regenerator can be about the same as before, because the regenerator continues to operate in complete CO combustion mode. The net coke make of the FCC reactor is still removed, even though all the coke on spent catalyst is not removed, so the amount of fuel burned in the regenerator remains roughly constant. Thus regenerated catalyst temperatures of 1150° to 1450° F. are contemplated, with most units expected to run in the 1250°–1350° F. range. If catalyst coolers, or less air preheat, are used to reduce regenerator temperature then temperatures from 10° to 150° F. below normal, typically 25° to 100° F. below normal may be used.

EXAMPLES

A series of tests were conducted to determine the effectiveness of various levels of coke on regenerated catalyst at reducing $NO_x$ emissions at the conditions experienced in FCC regenerators operating in complete CO combustion mode. Several sets of tests are reported, using two different sets of E-Cat.

The pilot plant was a large, continuous unit, with both a regenerator and a reactor, so that it was possible to test both the regenerator, and the reactor, to see if the increased coke on regenerated catalyst hurt conversion or yields. The unit processed about 10 pounds per hour of fresh feed.

The E-Cat used in runs 1 and 2 had a minor amount of Pt. The E-Cat used in test runs 3 and 4 was a different sample of E-Cat, and it is believed to have had more Pt, it had perhaps 1 ppm Pt, but we did not analyze directly for Pt.

| TEST RUN NO. | 1 | | 2 | | 3 | | 4 | |
|---|---|---|---|---|---|---|---|---|
| REGENERATOR CONDITIONS | | | | | | | | |
| AVG DENSE BED, °F. | 1300 | | 1298 | | 1299 | | 1282 | |
| CAT CIRC. dP | 6.1 | | 6.1 | | 4.87 | | 4.18 | |
| PSIA | 53.8 | | 54.2 | | 54.0 | | 53.6 | |
| CAT LEVEL $H_2O''$ | 20 | | 10 | | 20 | | 10 | |
| FLUE GAS COMPOSITION | | | | | | | | |
| $NO_x$, PPM | 151 | | 62 | | 249 | | 88 | |
| SOx, PPM | 324 | | 345 | | 280 | | 309 | |
| $O_2$ MOLE % | 2.6 | | 1.8 | | 2.8 | | 2.2 | |
| FCC CONDITIONS: | | | | | | | | |
| RISER TOP TEMP, °F. | 1011 | | 1013 | | 1008 | | 1010 | |
| RISER TOP, PSIG | 35.0 | | 35.0 | | 35.2 | | 35.3 | |
| OIL PARTIAL P, PSIA | 19.7 | | 20.2 | | 20.1 | | 20.0 | |
| FRESH FEED, G/HR | 4355 | | 4377 | | 4400 | | 4377 | |
| CAT:OIL WT:WT | 12.2 | | 12.2 | | 9.9 | | 8.1 | |
| STEAM, WT % OF FF | 7.0 | | 6.7 | | 6.7 | | 6.8 | |
| OIL CONTACT, SECS | 2.44 | | 2.54 | | 2.50 | | 2.55 | |
| CAT RES. TIME, SECS | 3.56 | | 4.67 | | 3.72 | | 3.93 | |
| COKE ON CATALYST: | | | | | | | | |
| COKE ON SPENT, WT % | 0.78 | | 0.83 | | 0.79 | | 0.84 | |
| COKE ON REGEN, WT % | 0.12 | | 0.17 | | 0.09 | | 0.10 | |
| WEIGHT BALANCE WT % | 101.3 | | 100.4 | | 95.7 | | 98.2 | |
| PRODUCT CUT POINTS | | | | | | | | |
| C5+ GASO. ASTM 90% | 360 | | 360 | | 360 | | 360 | |
| LCO ASTM 90% | 580 | | 580 | | 580 | | 580 | |
| PRODUCT YIELDS | WT % | VOL % | WT % | VOL % | WT % | VOL % | WT % | VOL % |
| CONVERSION | 80.9 | 82.3 | 80.1 | 81.3 | 68.6 | 79.8 | 76.3 | 77.5 |
| C5+ GASOLINE | 49.9 | 61.4 | 49.9 | 61.8 | 51.9 | 63.5 | 51.3 | 62.8 |
| LIGHT CYCLE OIL | 11.2 | 10.5 | 12.1 | 11.6 | 13.2 | 12.6 | 13.9 | 13.5 |
| MAIN COL BOTTS | 7.9 | 7.2 | 7.8 | 7.1 | 8.2 | 7.5 | 9.8 | 9.0 |
| COKE | 8.6 | | 8.3 | | 7.8 | | 6.6 | |
| TOTAL C4'S | 12.1 | 18.8 | 11.7 | 18.1 | 9.0 | 13.9 | 8.9 | 13.7 |
| TOTAL C3'S | 6.9 | 12.2 | 6.9 | 12.2 | 6.2 | 11.0 | 5.8 | 10.2 |
| C2 AND LIGHTER | 3.4 | | 3.3 | | 3.7 | | 3.7 | |
| TOTAL YIELDS | 100.0 | 110.1 | 100.0 | 110.8 | 100.0 | 108.5 | 100.0 | 109.2 |
| GASOLINE EFFIC. | 74.6 | | 76.0 | | 79.6 | | 81.0 | |
| CRACKABILITY | 4.6 | | 4.3 | | 4.0 | | 3.4 | |
| PRODUCT YIELDS | WT % | VOL % | WT % | VOL % | WT % | VOL % | WT % | VOL % |
| LIGHT HYDROCARBONS: | | | | | | | | |
| N-PENTANE | 0.72 | 1.05 | 0.70 | 1.02 | 0.61 | 0.89 | 0.53 | 0.77 |
| ISOPENTANE | 4.38 | 6.46 | 4.09 | 6.02 | 3.43 | 5.06 | 2.73 | 4.03 |
| PENTENES | 5.52 | 7.71 | 6.29 | 8.82 | 5.83 | 8.16 | 6.13 | 8.57 |
| TOTAL C5'S | 10.62 | 15.22 | 11.08 | 15.86 | 9.88 | 14.10 | 9.39 | 13.37 |
| N-BUTANE | 1.16 | 1.83 | 0.84 | 1.32 | 0.71 | 1.12 | 0.66 | 1.04 |
| ISOBUTANE | 3.60 | 5.88 | 3.44 | 5.63 | 2.51 | 4.10 | 2.17 | 3.55 |
| BUTENES | 7.49 | 11.14 | 7.38 | 11.14 | 5.77 | 8.71 | 6.02 | 9.09 |
| TOTAL C4'S | 12.15 | 18.85 | 11.67 | 18.08 | 8.99 | 13.93 | 8.85 | 13.68 |

-continued

| | | | | | | | | |
|---|---|---|---|---|---|---|---|---|
| PROPANE | 1.54 | 2.80 | 1.55 | 2.81 | 1.27 | 2.30 | 1.21 | 2.19 |
| PROPENE | 5.31 | 9.37 | 5.35 | 9.44 | 4.94 | 8.72 | 4.56 | 8.03 |
| ETHANE | 0.87 | | 0.95 | | 0.94 | | 1.00 | |
| ETHENE | 0.93 | | 0.84 | | 1.01 | | 1.06 | |
| METHANE | 1.16 | | 1.13 | | 1.27 | | 1.29 | |
| HYDROGEN | 0.11 | | 0.11 | | 0.14 | | 0.12 | |
| $H_2S$ | 0.30 | | 0.28 | | 0.34 | | 0.26 | |
| TOTAL DRY GAS | 9.93 | 12.17 | 9.94 | 12.25 | 9.57 | 11.02 | 9.23 | 10.22 |

The data are real data, so there is some scatter. Some results are typical of pilot plants, but not of commercial unit, i.e., the unit was oversized for this job. Lab units are frequently larger than they have to be, especially on the regenerator side, but commercial units are not. Thus all cases ran with considerably more excess air than we would like or expect in commercial practice.

In the test, the only significant change was leaving half the catalyst out of the regenerator, as evidenced by the pressure level in the regenerator, measured in inches $H_2O$. Leaving half the catalyst out increased coke on regenerated catalyst some, and greatly reduced $NO_x$. The lab unit is believed to be a reliable: predictor of what will happen in commercial bubbling bed regenerators operated with similar reductions in catalyst inventory.

These examples show that high levels of coke on regenerated FCC catalyst reduce $NO_x$ emissions from bubbling bed FCC regenerators and that it is possible to have essentially, complete CO combustion but only partial coke combustion in a bubbling bed unit. Surprisingly, there was little loss of conversion or gasoline yields.

The process of the present invention can be readily used in many existing FCC regenerators with little or only minor modifications to the unit. The benefits are immediate, and include reduced $NO_x$ emissions and longer catalyst life. In most units there will be essentially no capital or operating expenses associated with removing 20–50% of the catalyst inventory in the regenerator, leaving only that amount required by fluid dynamics to seal the catalyst return line, and that amount required by kinetics to burn the net coke make and produce regenerated catalyst containing the desired amount of coke.

We claim:

1. A process for the catalytic cracking of a nitrogen containing hydrocarbon feed to lighter products comprising:

a. cracking said feed by contacting said feed with a supply of hot, regenerated cracking catalyst in a fluidized catalytic cracking (FCC) reactor means operating at catalytic cracking conditions to produce a mixture of cracked products and spent cracking catalyst containing coke and nitrogen compounds;

b. separating said cracked products and spent cracking catalyst containing coke and nitrogen compounds to produce a cracked product vapor phase which is charged to a fractionation means and a spent catalyst phase which is charged to a stripping means;

c. stripping said spent catalyst in said stripping means to produce stripped catalyst containing coke and nitrogen compounds;

d. regenerating, in a single, dense phase, bubbling fluidized bed catalyst regeneration means., said spent cracking catalyst by contact with an oxygen-containing gas at complete CO combustion catalyst regeneration conditions sufficient to produce a flue gas having a $CO_2/CO$ mole ratio of at least 10:1 and to oxidize said nitrogen compounds to $NO_x$ and wherein said catalyst regeneration conditions include a catalyst inventory, a superficial vapor velocity, and a catalyst residence time sufficient to produce a regenerated catalyst containing at least 0.2 wt % coke and sufficient coke on catalyst in said regenerator to react with $NO_x$ formed therein and reduce at least a majority of the $NO_x$ formed in said regenerator to nitrogen within said regenerator by reaction with coke on catalyst; and e. removing regenerated catalyst, containing at least 0.2 wt % coke on catalyst, from said single, dense phase, bubbling fluidized bed catalyst regeneration means and charging same to said cracking reactor.

2. The process of claim 1 wherein the regeneration conditions include a regenerator flue gas oxygen concentration of less than 1 mole %.

3. The process of claim 1 wherein the regeneration conditions include a regenerator flue gas oxygen concentration of less than 0.5 mole %.

4. The process of claim 1 wherein the flue gas contains more CO than oxygen, on a molar basis.

5. The process of claim 1 wherein the bubbling dense bed regenerator produces a flue gas containing less than 1 mole % oxygen, and no more than 500 ppm CO.

6. The process of claim 1 wherein the bubbling dense bed regenerator produces a flue gas containing less than 0.8 mole % oxygen, no more than 200 mole ppm CO, and the coke on regenerated catalyst is at least 0.25 wt %.

7. The process of claim 1 wherein the catalyst has a large pore zeolite content, based on the zeolite content of fresh makeup catalyst, of at least 25 wt %.

8. The process of claim 1 wherein the catalyst has a large pore zeolite content, based on the zeolite content of fresh makeup catalyst, of at least 35 wt %.

9. The process of claim 8 wherein the coke on regenerated catalyst is at least 0.3 wt %.

10. A process for the catalytic cracking of a nitrogen containing hydrocarbon feed to lighter products comprising:

a. cracking said feed by contacting said feed with a supply of hot, regenerated cracking catalyst containing at least 25 wt % large pore zeolite content in a fluidized catalytic cracking (FCC) reactor means operating at catalytic cracking conditions to produce a mixture of cracked products and spent cracking catalyst containing coke and nitrogen compounds;

b. separating said cracked products and spent cracking catalyst containing coke and nitrogen compounds to produce a cracked product vapor phase which is charged to a fractionation means and a spent catalyst phase which is charged to a stripping means;

c. stripping said spent catalyst in said stripping means to produce stripped catalyst containing coke and nitrogen compounds;

d. regenerating said spent cracking catalyst in a catalyst regeneration means containing a single dense phase, bubbling fluidized bed by contact with an oxygen-containing gas to produce regenerated catalyst and $NO_x$ and wherein said catalyst regeneration conditions include a catalyst inventory, a superficial vapor velocity, and a catalyst residence time, wherein said regeneration conditions produce:

a flue gas having a $CO_2/CO$ mole ratio of at least. 10:1 and an oxygen content of less than 1.0 mole %;

regenerated catalyst containing at least 0.1 wt % coke and sufficient coke on catalyst in said regenerator to react with $NO_x$ formed therein and reduce at least a majority of the $NO_x$ formed in said regenerator to nitrogen within said regenerator by reaction with coke on catalyst as compared to operation in the same regenerator operated at conditions to produce only half as much coke on regenerated catalyst with twice as much oxygen in flue gas.

e. removing said regenerated catalyst and charging same to said cracking reactor.

11. The process of claim 10 wherein the regenerator flue gas oxygen concentration is less than 0.8 mole %.

12. The process of claim 10 wherein the regenerator flue gas CO concentration is less than 500 mole ppm.

13. The process of claim 10 wherein the regenerator flue gas CO concentration is less than 200 mole ppm.

14. The process of claim 10 wherein the regenerator flue gas CO concentration is less than 100 mole ppm.

15. The process of claim 10 wherein the regenerator flue gas CO concentration is less than 50 mole ppm.

16. The process of claim 10 wherein the flue gas contains more CO than oxygen, on a molar basis.

17. The process of claim 10 wherein the coke on regenerated catalyst is at least 0.2 wt %.

18. The process of claim 10 wherein the catalyst has a large pore zeolite content, based on the zeolite content of fresh makeup catalyst, of at least 35 wt %.

19. The process of claim 18 wherein the coke on regenerated catalyst is at least 0.3 wt %.

20. A method for reducing $NO_x$ emissions associated with the operation of an FCC catalyst regenerator associated with an FCC reactor cracking a nitrogen containing hydrocarbon feed to lighter products comprising:

a. cracking a nitrogen containing feed by contacting said feed with a supply of hot, regenerated cracking catalyst comprising at least 25 wt % large pore zeolite, based on the zeolite content of fresh catalyst addition, in a fluidized catalytic cracking (FCC) reactor means operating at catalytic cracking conditions to produce a mixture of cracked products and spent cracking catalyst containing coke and nitrogen compounds;

b. separating said cracked products and spent cracking catalyst containing coke and nitrogen compounds to produce a cracked product vapor phase which is charged to a fractionation means and a spent catalyst phase which is charged to a stripping means;

c. stripping said spent catalyst in said stripping means to produce stripped catalyst containing coke and nitrogen compounds;

d. charging said stripped catalyst to a catalyst regenerator means comprising a single vessel for maintaining an inventory of catalyst as a bubbling, dense phase, fluidized bed;

e. regenerating said stripped catalyst in said bubbling dense bed at complete CO combustion mode catalyst regeneration conditions including a catalyst residence time, temperature and air rates sufficient to burn coke and nitrogen compounds and wherein at least 90% of the carbon content of the coke is burned to $CO_2$ and less than 10% to CO, to produce a flue gas removed from said regenerator having a $CO_2/CO$ mole ratio of at least 10:1 and containing a given amount of $NO_x$, and a regenerated catalyst having a minor amount of coke;

f. reducing the inventory and/or residence time of the spent catalyst in said bubbling dense bed regenerator by at least 25% and operating said regenerator at reduced inventory regeneration conditions sufficient to:

reduce the $NO_x$ content of the regenerator flue gas by at least 50%;

maintain a $CO_2/CO$ mole ratio in the flue gas of at least about 10; and increase the amount of coke on regenerated catalyst at least 33% as compared to full inventory catalyst regeneration; and g. removing regenerated catalyst from said reduced inventory regenerator and charging same to said cracking reactor.

* * * * *